US005558353A

United States Patent [19]

Arduin et al.

[11] Patent Number: 5,558,353

[45] Date of Patent: Sep. 24, 1996

[54] DEVICE FOR MODIFYING THE FORCE DISTRIBUTION OF A SKI OVER ITS GLIDING SURFACE AND A SKI EQUIPPED WITH SUCH A DEVICE

[75] Inventors: Joël Arduin, Metz-Tessy; Jacques Le Masson, Cran-Gevrier, both of France

[73] Assignee: Salomon S.A., Metz-tessy, France

[21] Appl. No.: 256,630

[22] PCT Filed: Nov. 26, 1992

[86] PCT No.: PCT/FR92/01101

§ 371 Date: Oct. 27, 1994

§ 102(e) Date: Oct. 27, 1994

[87] PCT Pub. No.: WO93/14836

PCT Pub. Date: May 8, 1993

[30] Foreign Application Priority Data

Jan. 31, 1992 [FR] France ..... 92 01249

[51] Int. Cl.[6] ..... A63C 5/07

[52] U.S. Cl. ..... 280/602; 280/607

[58] Field of Search ..... 280/602, 607, 280/609, 615, 617, 618, 633, 634

[56] References Cited

U.S. PATENT DOCUMENTS

| | | | |
|---|---|---|---|
| 2,560,693 | 7/1951 | Hickman | 280/11.13 |
| 3,260,532 | 7/1966 | Heuvel | 280/602 |
| 5,129,668 | 7/1992 | Hecht | 280/607 |
| 5,135,250 | 8/1992 | Abondance et al. | 280/617 |
| 5,332,252 | 7/1994 | Le Masson et al. | 280/607 |
| 5,332,253 | 7/1994 | Couderc et al. | 280/602 |
| 5,393,086 | 2/1995 | Le Masson et al. | 280/602 |
| 5,397,149 | 3/1995 | Couderc et al. | 280/607 |

FOREIGN PATENT DOCUMENTS

| | | |
|---|---|---|
| 1270867 | 6/1990 | Canada . |
| 0182776 | 5/1986 | European Pat. Off. . |
| 0183586 | 6/1986 | European Pat. Off. . |
| 0230989 | 8/1987 | European Pat. Off. . |
| 0409749 | 1/1991 | European Pat. Off. . |
| 2259375 | 6/1974 | Germany . |
| 4101997 | 9/1991 | Germany . |

*Primary Examiner*—Anne Marie Boehler
*Attorney, Agent, or Firm*—Greenblum & Bernstein P.L.C.

[57] ABSTRACT

A device for modifying the pressure distribution of a ski such as especially an alpine ski over its gliding surface. The ski is equipped in its middle sole zone with at least one binding element adapted to retain a boot, and with at least one support element on which the sole of the boot rests. The device includes a stiffening blade that extends above the ski from the middle sole zone towards the front where it is affixed to the ski. It also includes a sensor element in contact with the sole of the boot, that is mobile along a vertical direction, and a connection between sensor element and stiffening blade, in order to transmit to stiffening blade, in the form of a force oriented along the horizontal and longitudinal direction of the blade towards the front, at least a portion of the downward vertical thrust of the boot captured by sensor element.

23 Claims, 13 Drawing Sheets

1
2
3
4
8
58
59
58
23
24
22
31
28
14
35
40
38
8

DEVICE FOR MODIFYING THE FORCE DISTRIBUTION OF A SKI OVER ITS GLIDING SURFACE AND A SKI EQUIPPED WITH SUCH A DEVICE

BACKGROUND OF THE INVENTION

1. Field of the Invention

The invention is related to a device for distributing the pressure of a ski, such as especially an alpine ski, over its gliding surface.

The invention is also related to an assembly of front and rear alpine ski binding elements, as well as an alpine ski, equipped with such a device.

2. Description of Background and Relevant Information

Skis used in alpine skiing are constituted by relatively long beans, on which the boots of the skier are retained by front and rear binding elements. The boots and binding elements are located approximately in the median zone of the ski, commonly known as the middle sole. At rest, the skis themselves have a natural arch, whereby the middle sole is naturally raised with respect to the front end of the ski, or shovel, and the rear end of the ski, or tail. In addition, the skis have a flexibility that depends on their internal structure. While skiing, the ski deforms elastically in response to the various forces to which it is subjected by the skier, as well as by the terrain over which it glides.

The main force to which the ski is subjected is constituted by the weight of the skier and the reaction to which the gliding surface subjects the ski.

The ski is also biased by the binding elements. In fact, it is known that the binding elements pinch the boot along a longitudinal direction. The reaction to this pinching action is transmitted by the binding elements to the ski. However, the nature of such reaction differs depending on the assembly mode of the rear binding element to the ski. Indeed, some rear binding elements are assembled directly onto the ski, whereas others are assembled to the front binding element by an inextensible connection, such as a metallic blade that extends beneath the boot.

The ski is also influenced by the position of the skier over his or her boots, depending on whether the skies carries his or her weight towards the front or towards the rear.

It is known that the behavior of the ski on the snow can be changed, especially its ease of turn initiation, its operational quality in turns or in a straight line, by influencing the arch of the ski, or by varying the longitudinal pressure distribution of the ski on the snow. By playing with such pressure distribution, it is known that the ski can be rendered more or less pivotal or more or less guiding, i.e., one can promote its ability to turn easily, and to have substantial operational stability. For skis that are currently on the market, the pressure distribution of the ski on the snow is mainly determined by the internal structure of the ski, and by the assembly mode of the binding elements to the ski, i.e., with or without connection blade between the front and rear binding elements. The distribution of pressure can also be influenced by the thrust intensity provided to the return springs.

There are devices with an attached element that enable the pressure distribution of the ski on the snow to be modified. As such, European patent application No. 183,586 describes a blade made of an elastic material of the spring blade type attached above the ski, between the binding elements and the ski. In the area of the front and rear ends, this blade has cursors whereby a portion of the forces to which the ski is subjected is transmitted vertically. However, this device has the disadvantage of mediocre performance with substantial space requirements. It is adapted for the case where both feet of the skier are in support on the same ski, in order to avoid the entire weight of the skier from being concentrated in the middle sole zone. On the other hand, it is ill-adapted in the case of a pair of conventional skis.

In accordance with the European patent application No. 409,749 applicants are also aware of a device constituted by a plate that is raised with respect to the upper surface of the ski maintained between two longitudinal abutments. Elastic shock absorption means are inserted between the plate and the abutments, and the pre-stress exerted on such elastic means is adjustable. As for the bindings, they are mounted on the plate. This device provides satisfactory results but its disadvantage lies in the fact that the binding elements are affixed to the attached plate and not to the ski itself. Other devices of the same type are described for example, in U.S. Pat. No. 2,560,693, and German patent No. 2,259,375.

With regard to these devices, it need only be said that the influence that they exert on the flexion of the ski is of a static type, i.e., they do not take into account the position of the skier on the skis while gliding.

SUMMARY OF THE INVENTION

One of the objects of the invention is to provide a device that enables the pressure distribution of a ski over its gliding surface to be modified dynamically, i.e., taking into account the position of the skier on the skis, and the vertical thrust force exerted by the skier on the skis while gliding.

Another object of the present invention is to provide a device that provides, in addition, a suspension effect to the skier while gliding.

Another object of the present invention is to provide a device that has, moreover, shock absorption qualities for the vertical vibrations of at least one end of the ski.

Other objects and advantages of the invention will become apparent from the description that follows, such description being, however, provided only as an example and nonlimiting.

The device according to the invention is intended to modify the pressure distribution of a ski, such as, especially an alpine ski over its gliding surface.

In its middle sole zone, the ski is provided with at least one binding element adapted to retain a boot, and at least one support element on which the sole of the boot rests.

The device also includes:

a stiffening blade that extends above the ski from the middle sole zone towards the front of the ski where its front end is affixed to the ski, a sensor element in contact with the sole of the boot, adapted to capture the vertical forces of the boot, connection means between the sensor element and the stiffening blade so as to transmit to such stiffening blade, in the form of a force oriented along its longitudinal and horizontal direction, towards the front, at least a portion of the downward vertical thrust of the boot captured by the sensor element.

BRIEF DESCRIPTION OF THE DRAWINGS

The invention will be better understood with reference to the description hereinbelow, as well as to the annexed drawings that form an integral part thereof.

DETAILED DESCRIPTION OF THE PREFERRED EMBODIMENTS

Figure 1:
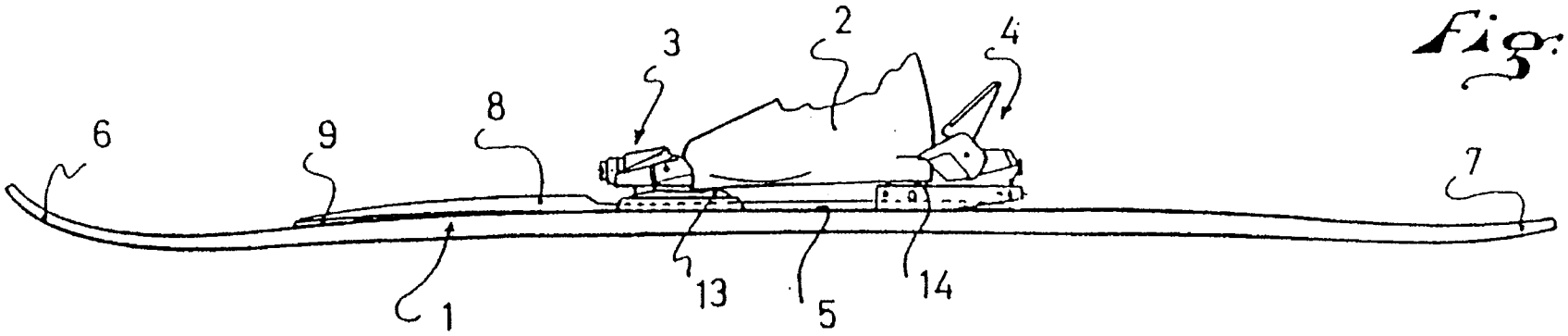
FIG. 1 is a general side elevation view of a ski equipped with a device according to a first non-limiting embodiment of the invention.

FIG. 1 represents, in a side view, a ski 1 on which a shoe or boot, depicted by reference numeral 2 is retained by means of a front binding element 3 and a rear binding element 4.

Boot 2 and binding elements 3 and 4 are located in the central zone 5 of the ski, which is also known as the middle sole. The ski has, moreover, a raised front end 6 or shovel, and a rear end 7 or tail.

In its front portion, ski 1 is equipped with a stiffening member or blade 8, whose front end 9 is affixed to the upper surface of the ski between front binding element 3 and shovel 6. In FIG. 1, end 9 of stiffening blade 8 is located approximately in the front quarter of the ski.

From this end 9, stiffening blade 8 extends above the upper surface of the ski in the direction of the middle sole.

Stiffening blade 8 is made of any appropriate material that is adapted to resist a compression force oriented along the length of the blade. Preferably, the material is also selected such that the blade exhibits elastic flexional qualities in the vertical and longitudinal plane defined by the ski. For example, stiffening blade 8 can be made of a composite material, and possibly be filled with fibers.

Front end 9 of the blade is affixed to the ski by any appropriate means, for example, by adhesion, screwing or welding. It can also be affixed by a joining piece affixed to the ski against which the end of the blade is in support. A layer of material exhibiting shock absorption qualities could also be inserted between front end 9 of the blade and the upper surface of the ski.

Figure 2:
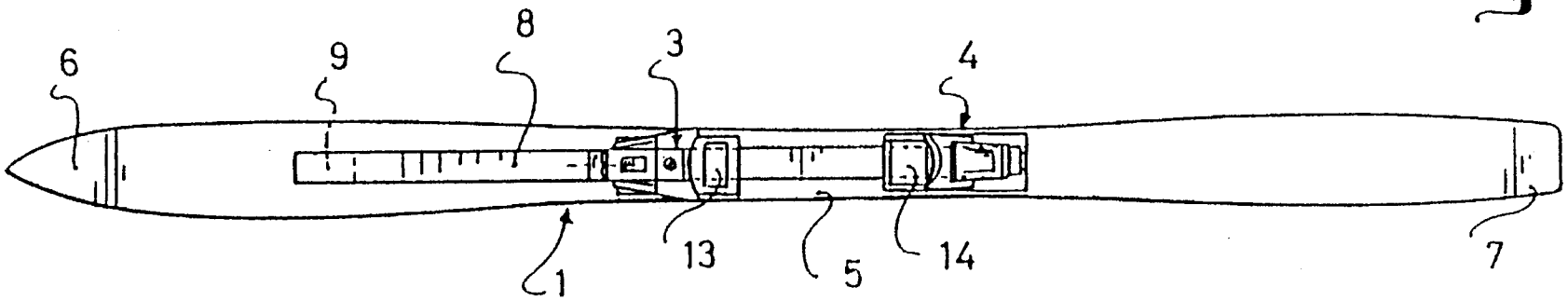
FIG. 2 is a top plan view of the ski represented in FIG. 1.

Furthermore, the blade has a width and thickness that can be constant or variable along its length. Preferably, however, the width of the blade is less than the width of the ski, as can be seen from FIG. 2.

Figure 3:
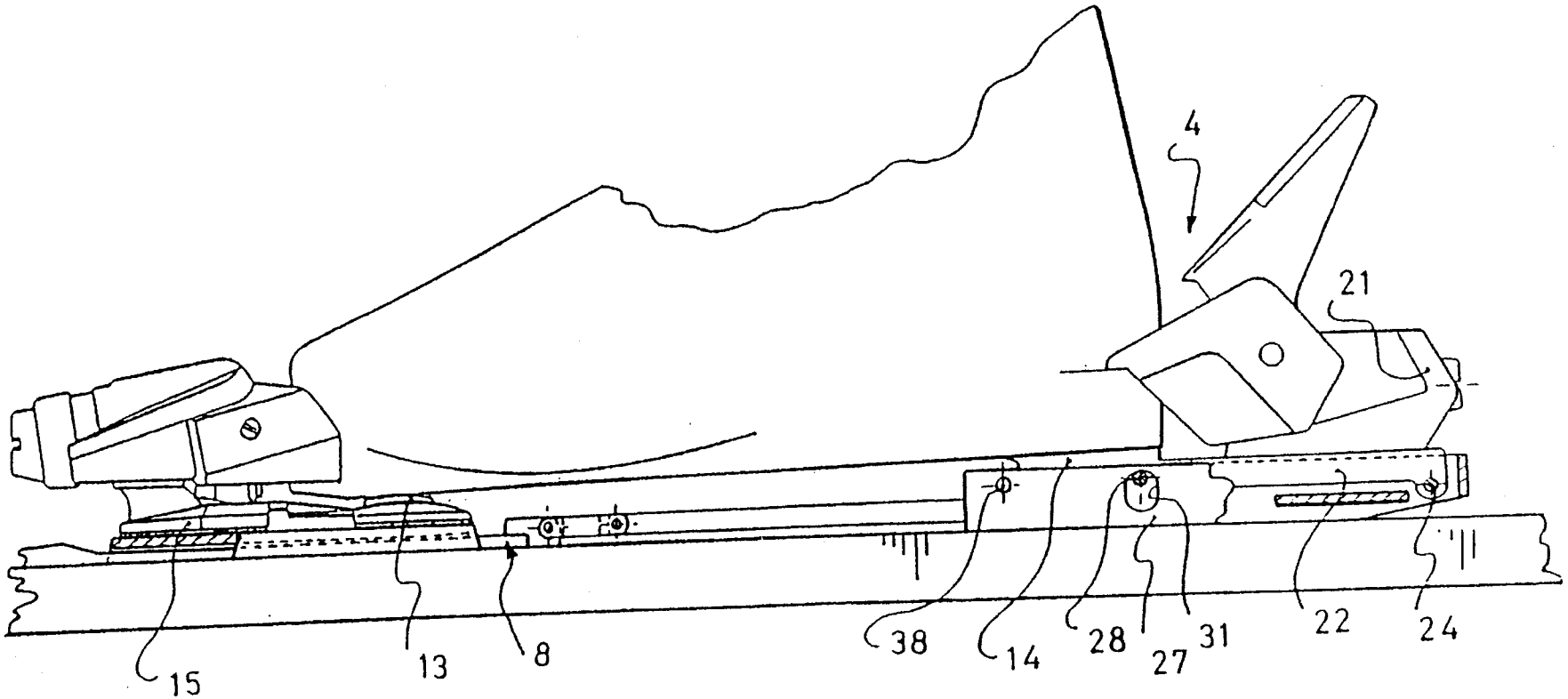
FIG. 3 is a partial sectional side elevation view of the ski represented in FIG. 1, in its middle sole zone.

With reference to FIG. 3, boot 2 is retained by a front binding element 3 and a rear binding element 4. The binding elements 3 and 4 are themselves of any appropriate type, and in a known way, the sole of the boot rests on a front support element 13 and a rear support element 14 that are respectively associated to the front binding element and to the rear binding element.

Figure 4:
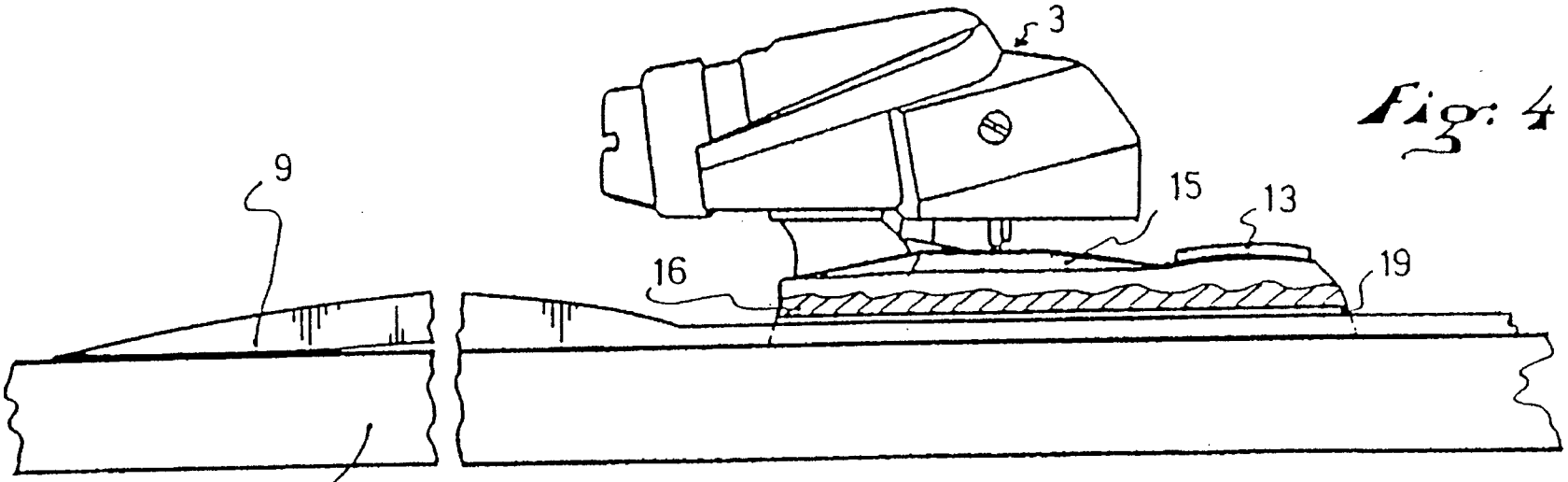
FIG. 4 is a partial sectional side elevation view of the ski represented in FIG. 1, in its front portion.
Figure 5:
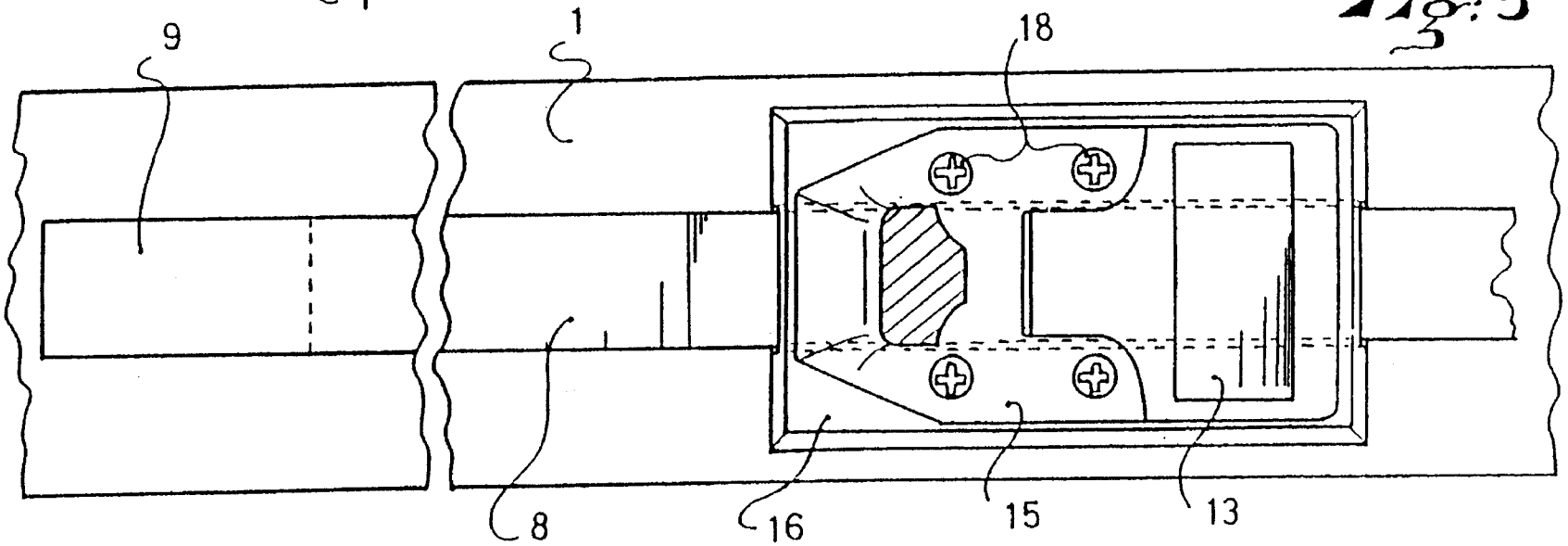
FIG. 5 is a top plan view of the device represented in FIG. 4.

Front binding element 3 has, in its lower portion, a base plate 15 that is affixed to the ski. With reference to FIGS. 4 and 5, base plate 15 is mounted on a base 16, and both of these elements are assembled to ski 1 by screws 18.

In a transverse section, base 16 is U-shaped, i.e. it has on its length, in its lower portion, a longitudinal recess 19 through with stiffening blade 8 freely extends. Base 16 ensures the assembly of binding element 3 on the ski and also ensures a guiding function of blade 8, mainly in order to stop it from buckling in this area.

With respect to ski 1, stiffening blade 8 fulfills a variety of functions. Firstly, a frontward longitudinal thrust force exerted on blade 8 from the middle sole zone is translated in the area of front end 9 of the blade by a flexional moment exerted on the front end of the ski, and that tends to make this end plunge toward the snow. Conversely, a flexional bias of the front of the ski, for example due to the terrain over which the ski glides, is brought by blade 8 in the middle sole zone in the form of a low-amplitude longitudinal translation with respect to the ski, or of a longitudinal thrust bias oriented rearwardly.

Blade 8 also assumes, by virtue of its vertical elasticity, a shock absorption role of the vertical vibrations to which the front portion of the ski is subjected.

In addition to stiffening blade 8, the device according to the invention has a sensor element that is in connection with the sole of the boot and that is adapted to capture the vertical forces of the boot on the ski, especially the downward vertical forces. In addition, the device comprises connection means between the sensor element and the stiffening blade, so as to transmit to the stiffening blade, in the form of a frontward longitudinally oriented thrust force, at least a portion of the downward vertical thrust that the boot exerts on the sensor element. According to the embodiment illustrated in the drawings, the sensor element that captures the vertical forces of the boot is constituted by a rear support element 14 that is associated to rear binding element 4, and on which the rear end of the sole of the boot rests.

In a known manner, rear binding element 4 has a body 21 that is movable along a slide 22. The slide extends forwardly beyond body 21, in order to constitute rear support element 14 on which the boot rests.

With reference to the drawings, slide 22 is connected to the ski by a journal about a horizontal and transverse axis 24, that allows slide 22, and thus also rear support element 14, an approximately vertical movement along a direction parallel to the median longitudinal and vertical plane defined by the ski. This, however, is non-limiting and any other appropriate means may also suffice.

Figure 6:
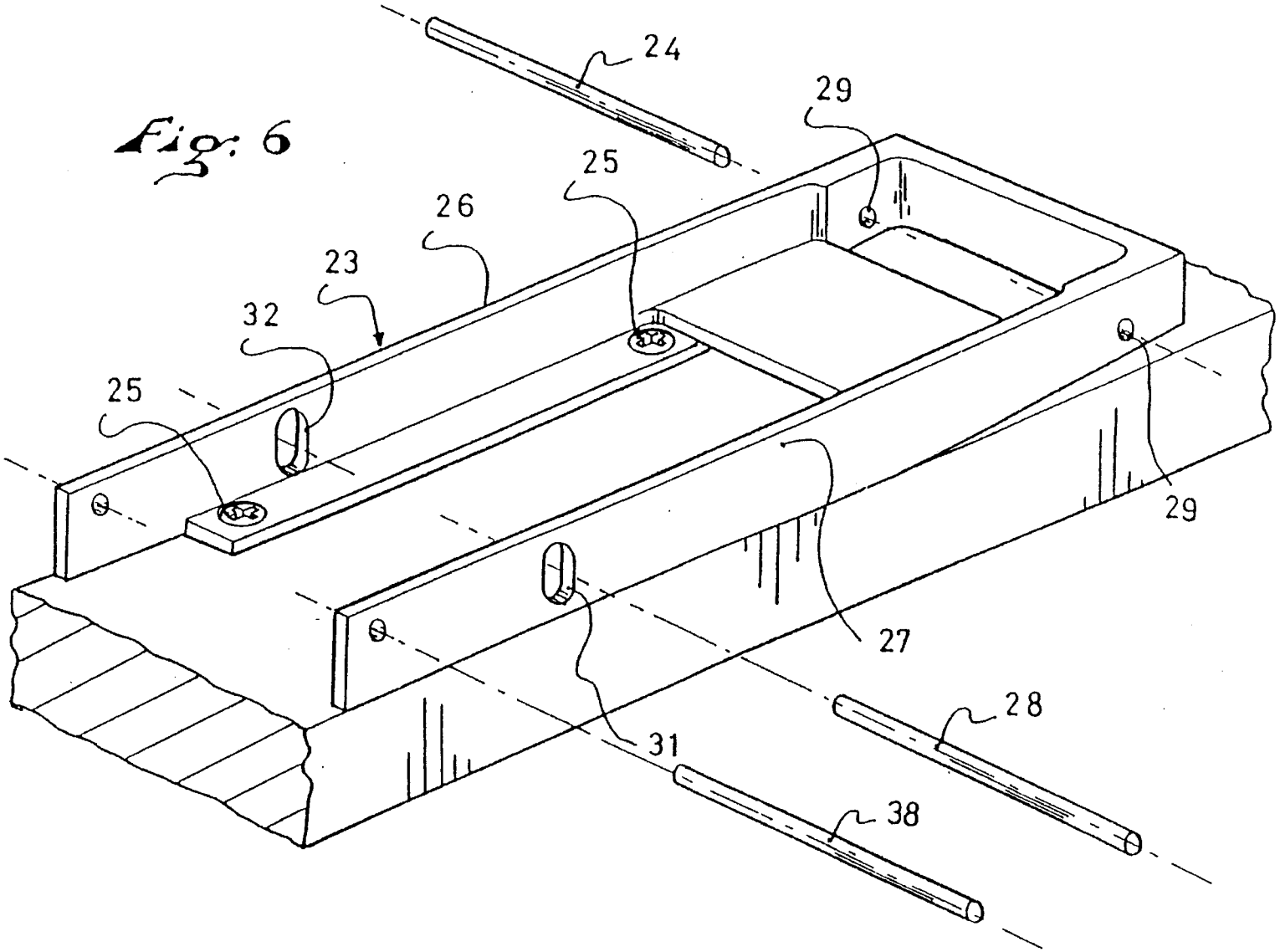
FIG. 6 is a perspective view of the base that supports the rear binding element.

FIG. 6 represents a perspective view of base 23 that is affixed to the ski, and that bears rear binding element 3. Base 23 is affixed to the ski by any appropriate means, and for example, by screws 25. Laterally, it has two vertical and longitudinal wings 26 and 27, whose spacing is equal to or greater than the width of slide 22. In the rear portion, each of the wings 26 and 27 has an opening 29 for journal axle 24 of slide 22.

Figure 7:
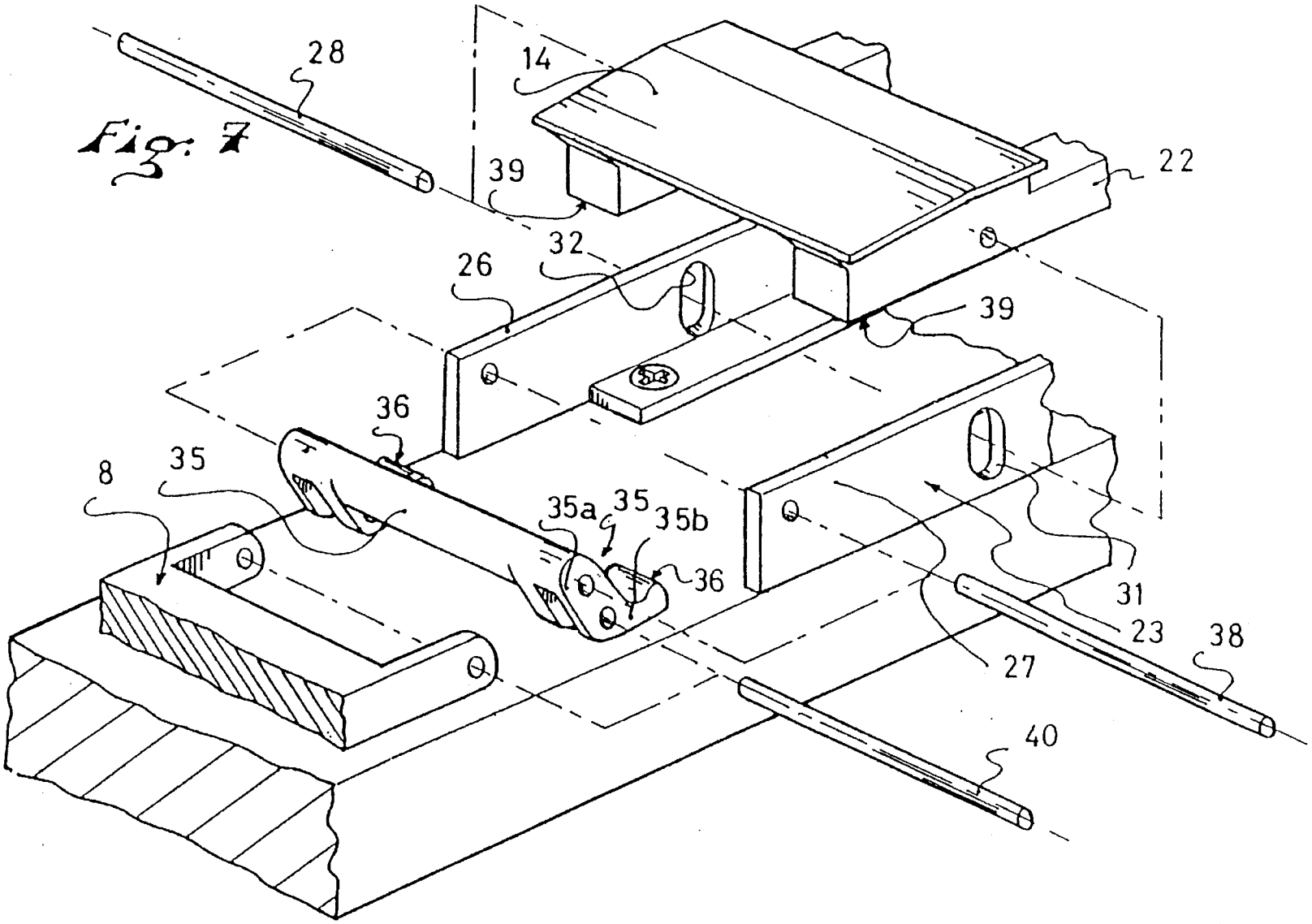
FIG. 7 is a partial exploded perspective view that illustrates the connection means.

With reference to FIG. 7 the rotational movement of slide 22 about the axis of axle 24 is preferably limited downwardly and upwardly. The means that enable this restraint are represented in the drawings in the form of a pin 28, that is located in the front portion of slide 22. The ends of the pin cross wings 26 and 27 in the area of slots 31 and 32 oriented along a vertical direction. The rotation of slide 22 about the axis of axle 24 is limited upwardly by pin 28 coming into abutment in the upper portion of slides 31 and 32. The downward restraint is limited either by the ski itself or by the pin coming into abutment in the lower portion of slots 31 and 32.

Elastic return means or shock absorption means (not represented) could possibly be located between the upper surface of the ski and slide 22 in order to elastically return the slide and rear support element 14 upwardly.

Thus, base plate 14 can be displaced along an approximately vertical direction in response to the forces to which the boot subjects it.

The connection means between the sensor element, i.e., rear support element 14, and stiffening blade 8 are represented in the drawings in the form of a pivotable element 35 with two arms, one vertical arm 35*a* and one horizontal arm 35*b*. Pivotable element 35 is borne by wings 26 and 27 of base 23 by means of a journal axle 38 that is located in the upper portion of vertical arm 35*a*.

The horizontal arm 35*b* is oriented rearwardly, and its rear end has support zones or surface 36 that bear along a vertical direction slide 22 by means of plates 39 that are located in the front portion, approximately beneath support element 14.

In its central portion, i.e., at the junction of the two arms 35*a* and 35*b*, pivotable element 35 has a journal axle 40 by which the rear end of stiffening blade 8 is connected to pivotable element 35.

It is to be understood that in response to a downward vertical bias exerted on such support zones 36, pivotable element 35 pivots about the axis of its axle 38, causing stiffening blade 8 to be translated longitudinally towards the front. The dimensions and placements of the various elements are naturally determined in a way that such a movement can occur without interference with the upper surface of the ski. In particular, to enable rotation of pivotable element 35, the rear end of stiffening blade 8 is substantially raised with respect to the upper surface of the ski.

Preferably, stiffening blade 8 is subject to a compression pre-stress directed towards the middle sole whereby it tends to make pivotable element 35 pivot in the direction that brings rear support element 14 back into a raised position. The energy of such pre-stress is taken mainly from a flexional pre-stress of the front portion of the ski.

Figure 8:
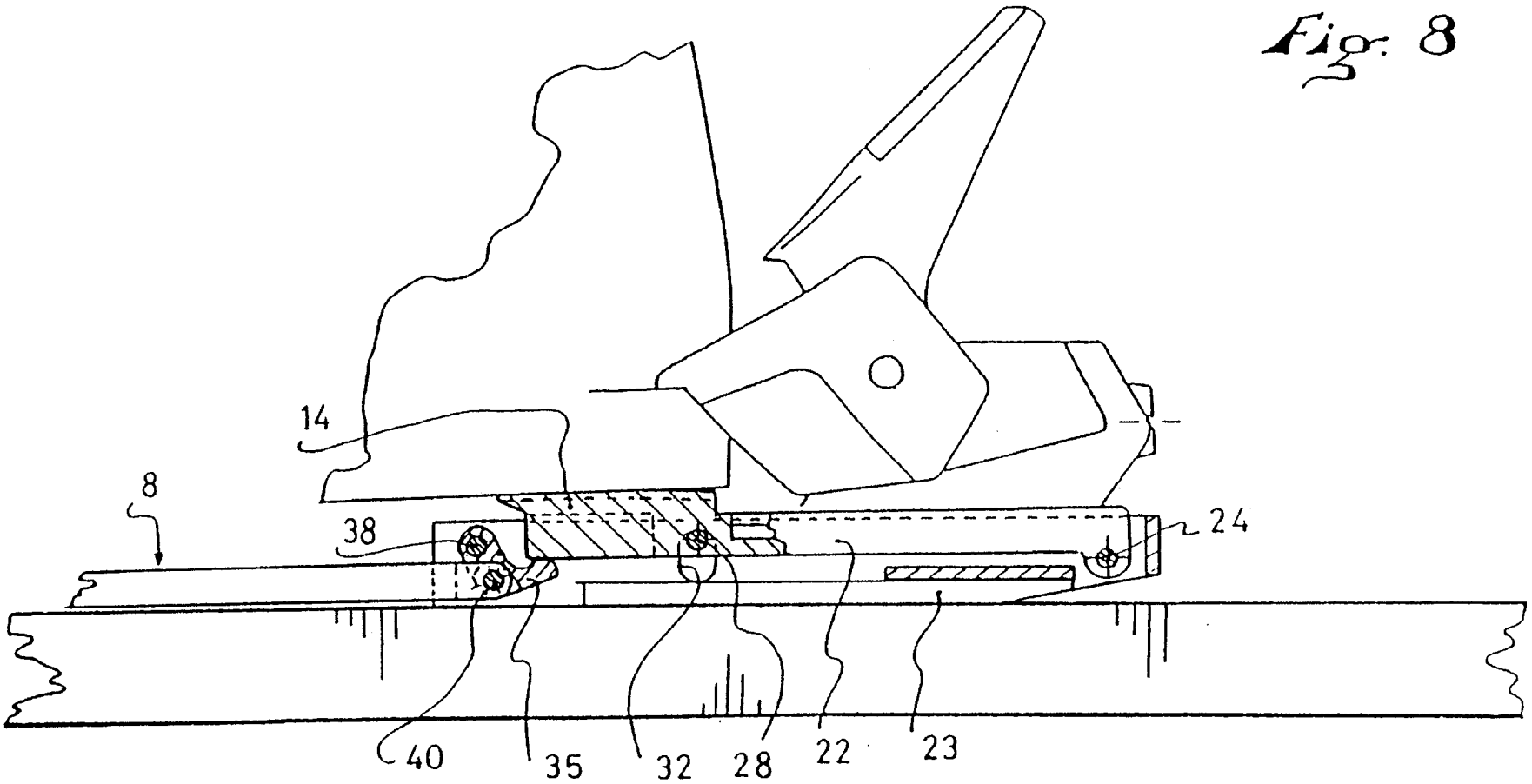
FIG. 8 is a partial perspective side elevation view of the ski of FIG. 1 in the rear binding element zone.
Figure 9:
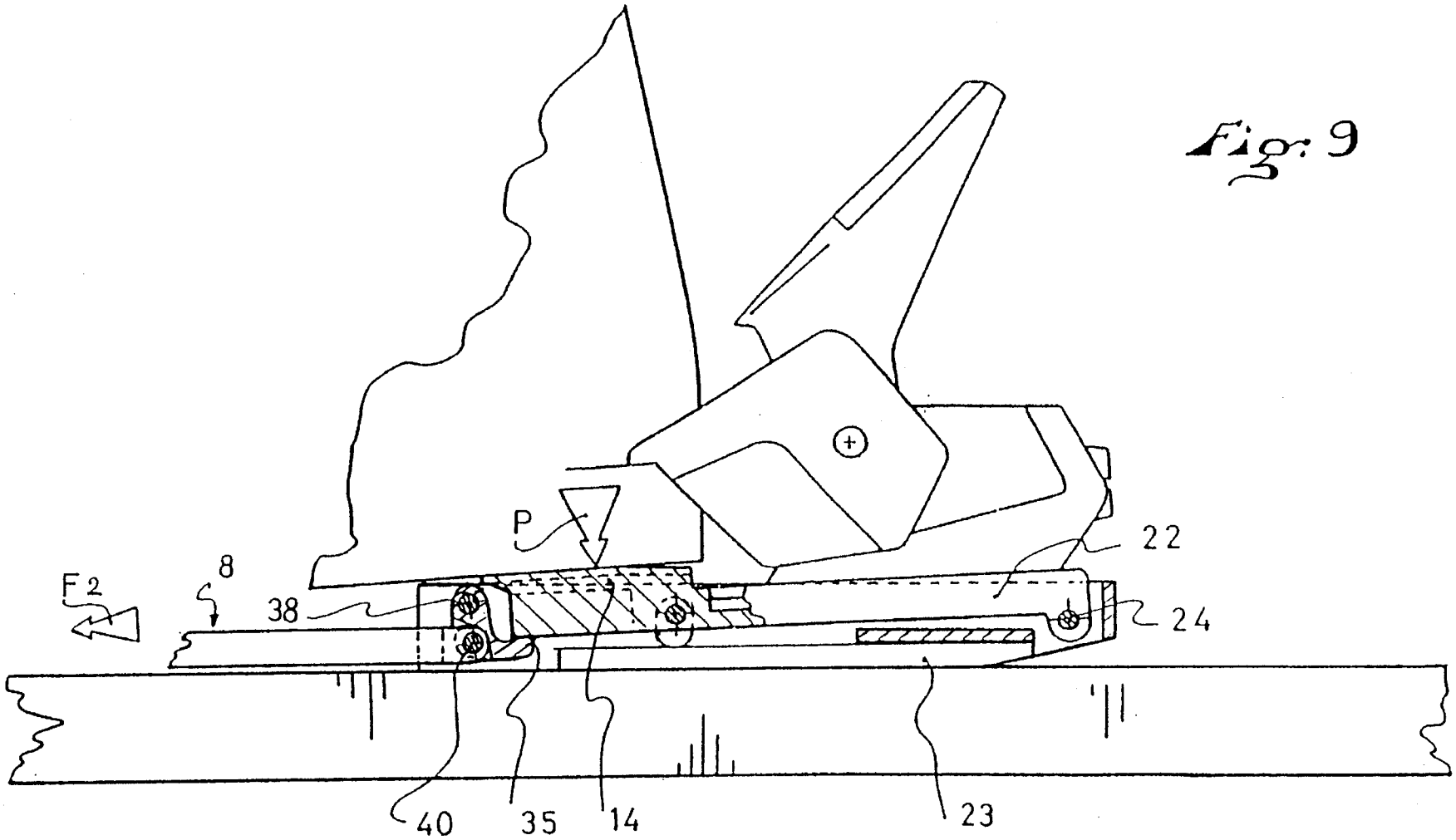
FIG. 9 represents the device of FIG. 8 in another operational position.

FIGS. 8 and 9 illustrate the functioning of the device described hereinabove. According to FIG. 8, the vertical thrust that the boot exerts on rear support element 14 is less than the pre-stress to which the stiffening blade subjects pivotable element 35. Support element 14 is thus located in its raised position, i.e., pin 28 is in abutment in the upper portion of slots 31 and 32. In FIG. 9, the boot exerts an additional thrust represented schematically by arrow P on rear support element 14. This thrust P rotationally drives pivotable element 35 about the axis of its axle 38, which generates, in stiffening blade 8, a longitudinal thrust force oriented frontwardly, represented schematically by arrow F. This thrust is transmitted to front end 9 of stiffening blade 8, where it induces a flexional moment that is exerted on the front portion of the ski. This flexional moment tends to make the front end of the ski plunge towards the snow. Thus, if the skier displaces his or her weight towards the rear during the glide, the additional thrust force that this displacement induces and that is captured on rear support element 14 is transformed and sent back towards the front in the form of a flexional moment that tends to make the front end of the ski plunge in the snow.

When the additional thrust of thrust P disappears, stiffening blade 8, by virtue of its pre-stress, brings back rear support element 14 and the boot into its original position, i.e., the position represented in FIG. 8.

It ought to be noted that the vertical forces exerted by the boot on its rear support cause a vertical movement of such rear support against the elastic forces. A shock absorption or suspension effect of the rear end of the boot is thus obtained. Conversely, the rocking movements of the boot are transmitted directly to the ski, in light of the fact that sensor 14 does not react to this type of movement. The sensor is in fact connected to the ski by a transverse journal axle borne by base 23.

As mentioned above the material of stiffening blade 8 preferably has vertical flexional qualities. In light of the fact that stiffening blade 8 extends towards the front of the ski beyond front binding element 3, it also assumes a vertical shock absorption role of the vibrations to which the front of the ski is subject during the glide.

Figure 10:
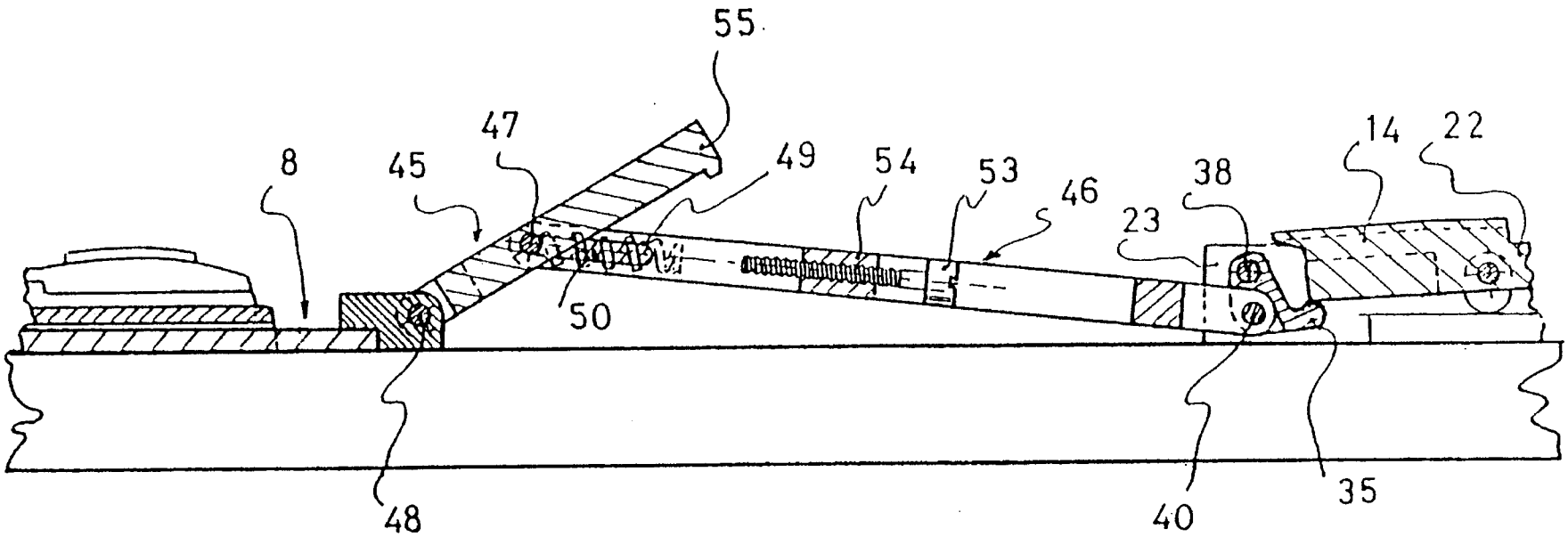
FIG. 10 is a side elevation sectional view of the stiffening blade in the middle sole zone, according to a preferred embodiment of the invention.
Figure 11:
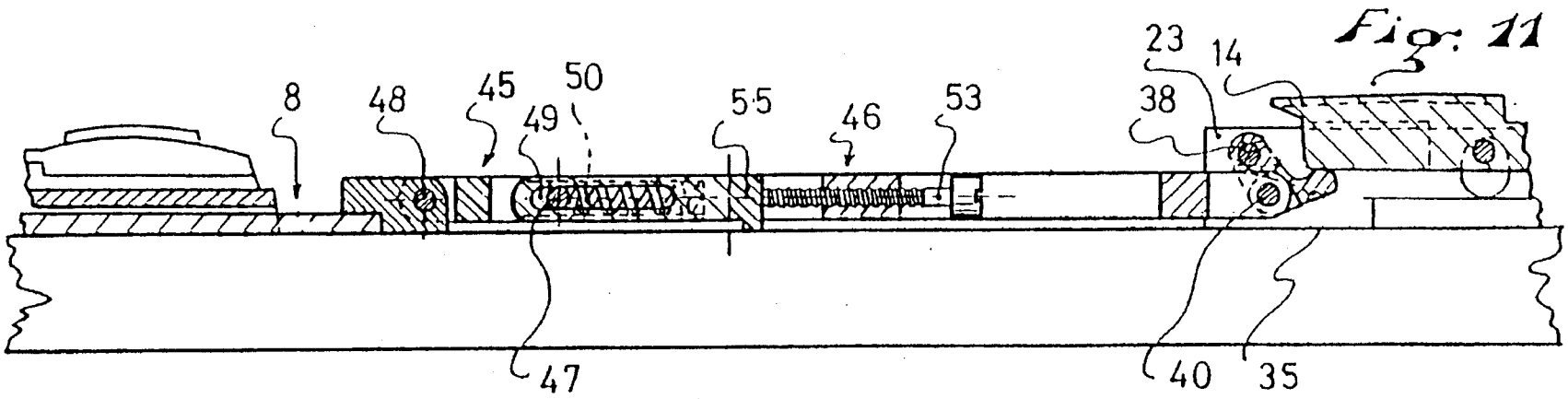
FIG. 11 is a view that represents the stiffening blade of FIG. 10 in another functional position.
Figure 12:
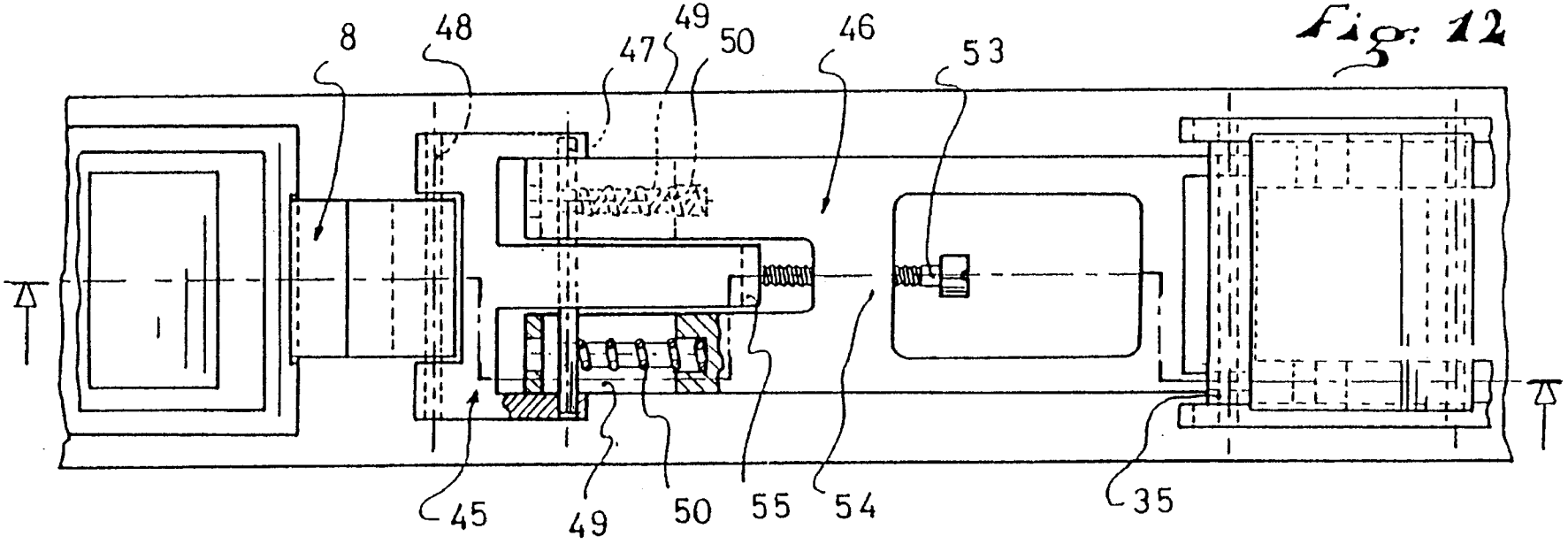
FIG. 12 is a top plan view of the device represented in FIG. 11.

FIGS. 10 through 12 represent a preferred embodiment of stiffening blade 8. As per this embodiment, blade 8 has, along a portion of its length, two elements 45 and 46 that are oriented along the longitudinal direction of the ski and that are journaled with respect to each other and to the remainder of the blade in the manner of a knuckle joint about a horizontal and transverse axis. This knuckle joint can be open or flattened. If it should be open, the compression pre-stress disappears in stiffening blade 8. Conversely, this pre-stress is re-established when the knuckle joint is flattened.

With reference to FIG. 10, stiffening blade 8 has, in the middle sole zone, two elements 45 and 46 that are journaled with respect to each other about a horizontal and transverse axle 47. In addition, element 45 is journaled at the front to the remainder of the blade about a transverse axle 48, and the rear end of element 46 is journaled to tipping element 35 about axle 40 mentioned previously.

Journal axle 47 of both elements is borne by element 46 in a slot 49 oriented along the longitudinal direction of element 46. Within such slot, axle 47 is pushed towards the front by at least one spring 50.

When the knuckle joint constituted by elements 45 and 46 is open, i.e., in the position of FIG. 10, spring 50 pushes axle 47 towards the front until the end of the slot, that is in the direction of the opening of the knuckle joint. There is no pre-stress in stiffening blade 8 and rear support element 14 falls if no other elastic means retains it upwardly.

In the flattened position of the knuckle joint represented in FIG. 11, axle 47 is displaced in slot 49 against the return force of springs 50, which induces a pre-stress in stiffening blade 8. This pre-stress is transmitted by reaction to the ski and to the pivotable element.

Preferably, in this position, the abutment means form a coupling of the two elements 45 and 46 in case of any displacement and any longitudinal bias. These means are represented in the form of a micrometric screw 53 that is screwed in a brace 54 of element 46 and that is placed in abutment against a tongue 55 located at the rear of element 45. In this way, the longitudinal compression forces that stiffening blade 8 transmit from the rear to the front and from the front to the rear, are directly transmitted by elements 45 and 46 without causing additional compression of springs 50.

To return the knuckle joint to its raised position, screw 53 is slightly loosened, then a manual action is exerted on one of elements 45 or 46.

Figures 13, 14:
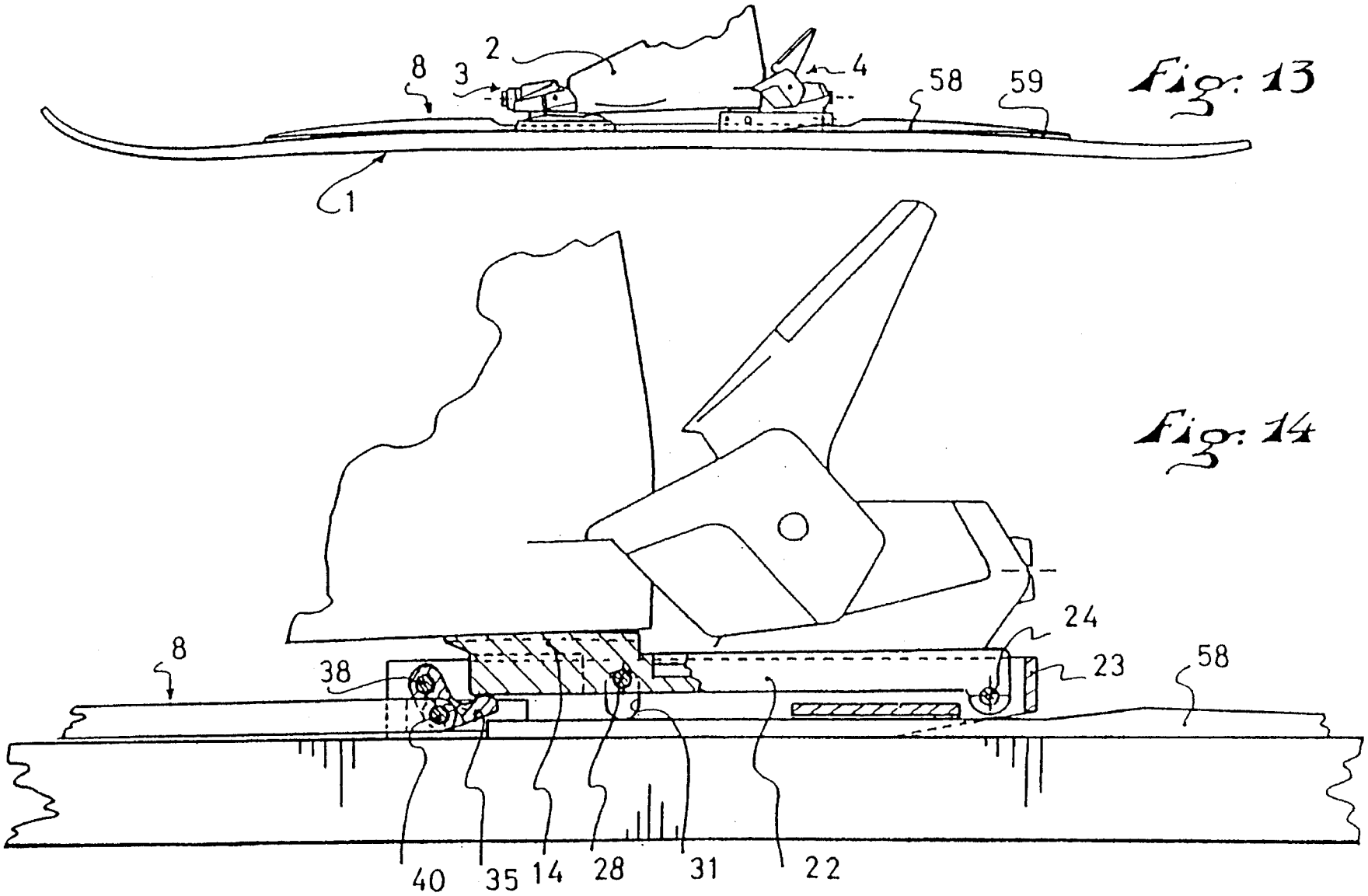
FIG. 13 is a general side elevation view of a device according to a variation of the invention.
FIG. 14 is a partial sectional side elevation view of the ski of FIG. 13 in the rear binding element zone.

FIG. 13 illustrates an embodiment whereby ski 1 is equipped with, in addition to stiffening blade 8, a rear stiffening member of blade 58 that extends from the middle sole zone towards the rear of the ski, where its end 59 is affixed to the upper surface of the ski. FIG. 13 represents one end 59 of member 58 located approximately in the rear quarter of the ski.

The connection between blade 8 and member 58 is such that a rearward compression bias exerted on blade 8 is transmitted to member 58. Similarly, a frontward compression bias exerted on member 58 is transmitted to blade 8. Conversely, a compression bias exerted on blade 8 by pivotable element 35 is transmitted to blade 8, but not to member 58.

Figure 15:
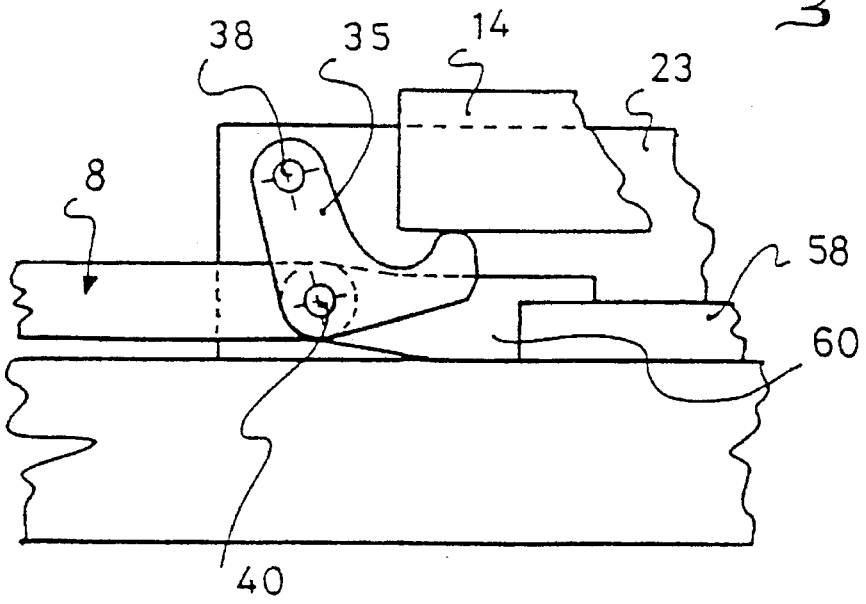
FIGS. 15 and 16 are side views that illustrate the functioning of the connection means represented in FIG. 14.
Figure 16:
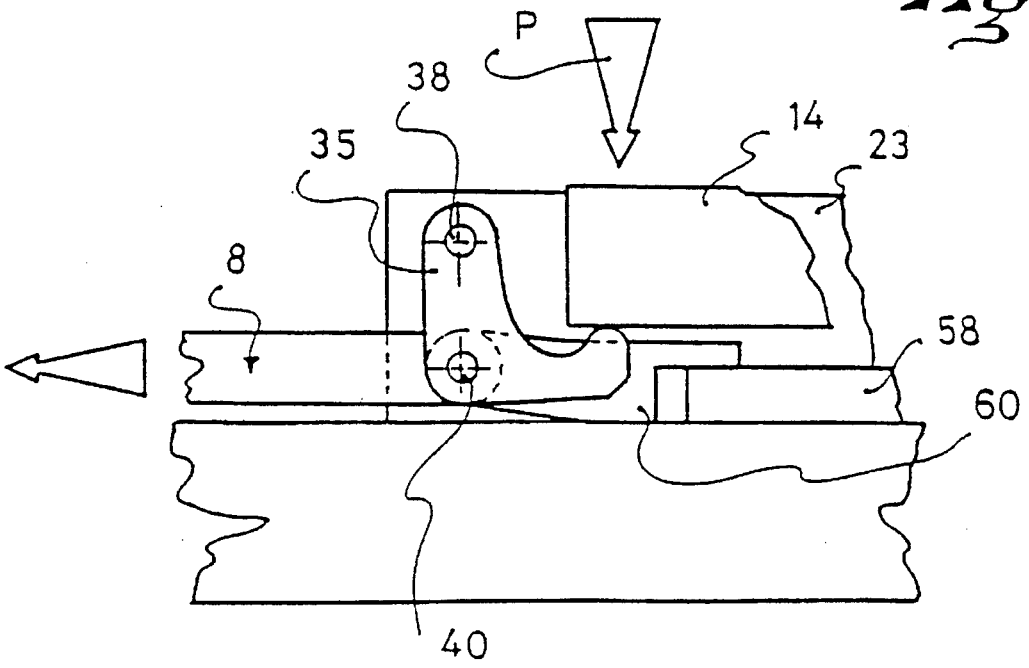

With reference to FIGS. 14 through 16, the front end of member 58 freely crosses base 23 of rear binding element 3 along a longitudinal direction. The front end of member 58 is in simple support against an abutment element 60 that is connected to pivotable element 35 at the same journal axle 40 as that ensuring the connection with stiffening blade 8. Element 60 transmits the compression biases from one element to another 8 or 58. Conversely, as is illustrated in FIG. 16, a thrust P exerted on support element 14 rotationally drives pivotable element 35 and causes a forward translation of stiffening blade 8. Abutment element 60 is displaced with the movement of pivotable element 35, without however driving rear member 58 with it, the rear member being free to be displaced or not depending on the biases to which the rear end of the ski is subjected.

In addition to the operational mode described with respect to FIGS. 8 and 9, the present device transmits towards the front, in the form of a flexional moment, a flexional bias to which the rear end of the ski is subjected. Inversely, a compression bias exerted on stiffening blade 8, originating from a flexional bias of the front of the ski is transmitted by member 58 to the rear end of the ski, as long as pin 28 that limits the pivotable movement of slide 22 is not in upper abutment in slots 31 and 32. If pin 28 is in abutment, the bias is absorbed in the area of pivotable element 35.

Figure 17:
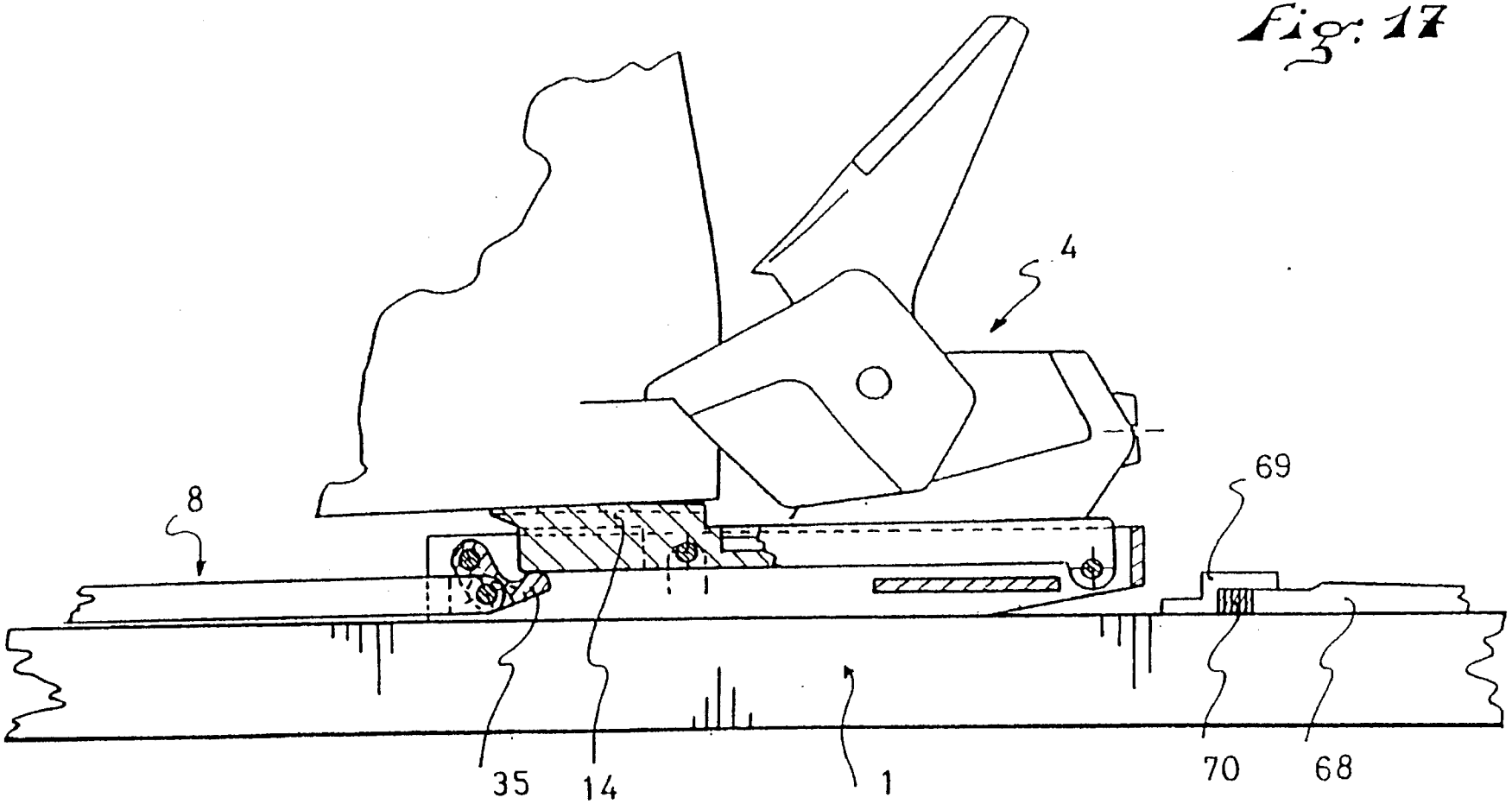
FIG. 17 is a partial sectional side elevation view at the level of the rear binding element, of a device as per another embodiment variation of the invention.

FIG. 17 represents another variation according to which ski 1 has, in its rear portion, a stiffening member 68 of the same type as previous member 58. However, the front end of member 68 is in support against an abutment 69 affixed to ski 1 at the rear of rear binding element 4. A spring or a block 70 made of a shock absorbing material could be inserted between the front end of member 68 and abutment 69. Rear end 68 thus assumes a vertical or longitudinal shock absorption role of the rear end of the ski. Inversely, there is no direct relation between blade 8 and member 68. Thus, they independently exert an action on the ski.

Figure 18:
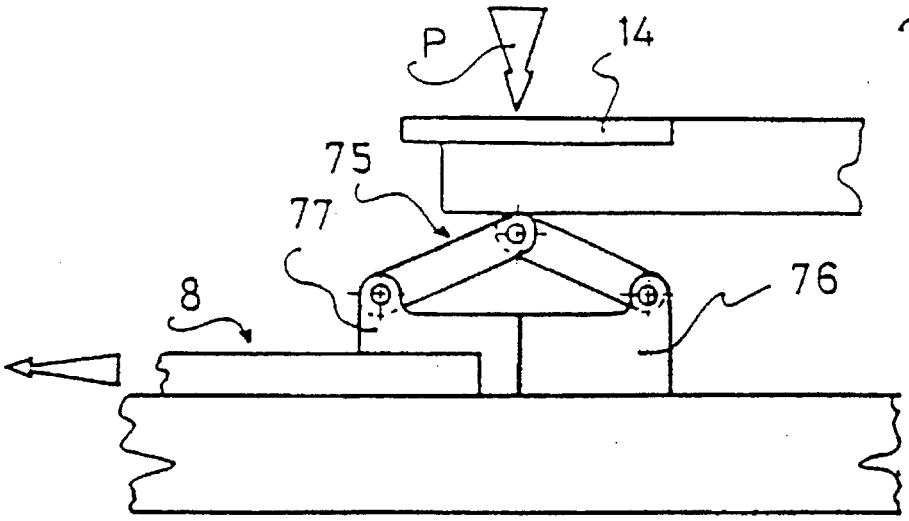
FIGS. 18 through 20 schematically represent embodiment variations of the connection means.
Figure 19:
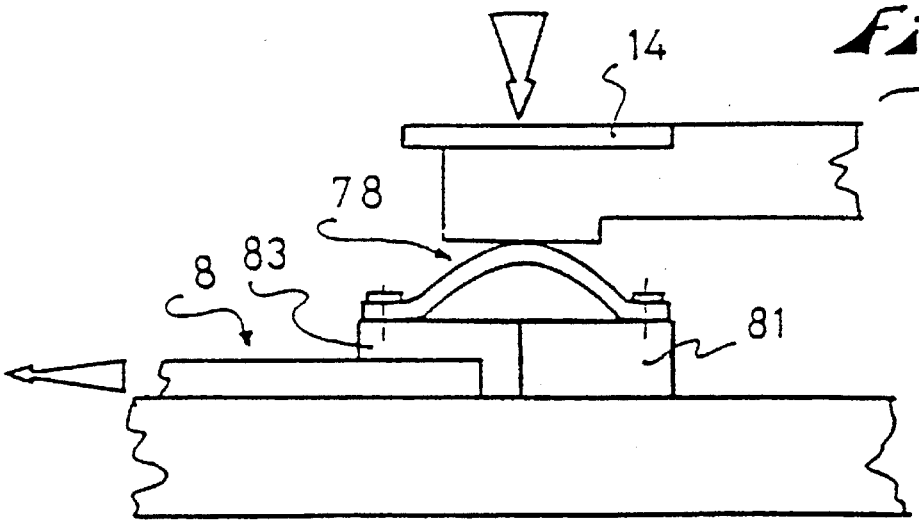
Figure 20:
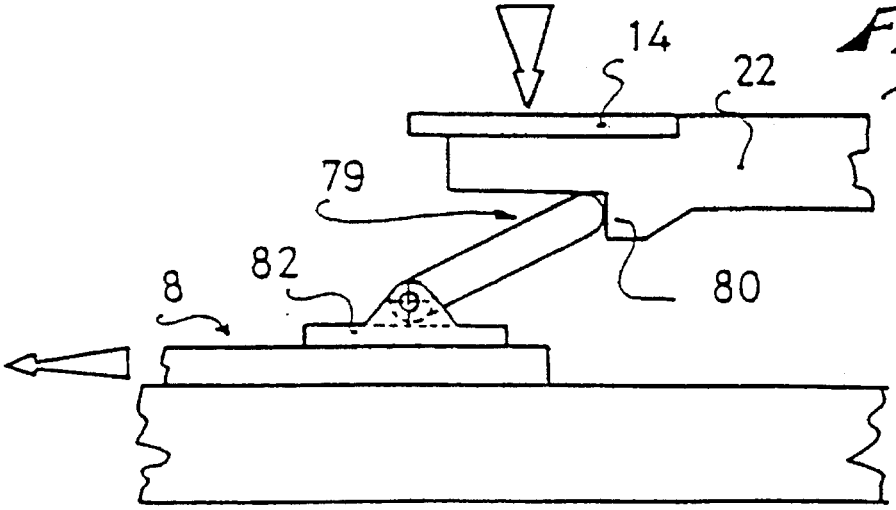

FIGS. 18 through 20 illustrate structural variations in the area of the connection means. In accordance with FIG. 18, pivotable element 35 is replaced by a knuckle joint device 75 whose rear end is connected, by journal, to an element 76 affixed to the ski, and the front end is connected to a connection element 77 that is in support against blade 8 along a longitudinal direction oriented towards the front. As for rear support element 14, it is in support on device 75 in the area of the journal of the two elements. A thrust force P, exerted on support element 14, causes a flattening of knuckle joint 75, which leads to a forward movement of connection element 77 that drives stiffening blade 8.

FIG. 19 represents a device of the same type, but knuckle joint 75 is replaced by a convex strip 78. Support element 14 comes to rest on the central portion of the strip. The ends of the convex strip are fixedly connected to an element affixed to the ski and to a connection element 83 affixed to blade 8. The functioning is similar to the one previously described.

FIG. 20 represents another variation according to which it is an inclined lever 79 that ensures the connection between slide 22 and blade 8. Lever 79 is in support against an abutment 80 of slide 22, and it transmits its inclination variations to blade 8 by means of an element 82 affixed to the rear end of the blade.

Naturally, the present description has only been provided as an example, and other embodiments of the invention could be adopted without leaving its scope. In particular, other variations could be adopted in the area of the connection means. Similarly, an independent sensor element could be implemented, i.e., a sensor that is not associated to a binding element, or one that could be associated to the front binding element.

The sensor can also be independent of the front and rear support elements on which the sole of the boot rests. For example, it can be located in the central portion of the sole approximately in the middle of the front and rear elements. Other variations are also possible.

We claim:

1. A device for modifying force distribution of a ski over a gliding surface of the ski, the ski extending in a longitudinal direction, the ski furthermore having a central zone with at least one binding element for retaining a boot and at least one support element for supporting a sole of the boot, said device comprising:

a stiffening blade having a front end and a rear end, the front end of the stiffening blade being adapted to be affixed to a forward portion of the ski, the forward portion of the ski being forward of the central zone, the stiffening blade having a predeterminate length so that the rear end of the stiffening blade is adapted to be located in the central zone;

a sensor element for supporting only a portion of the sole of the boot and for capturing a vertical thrust force of the boot; and a connection between the sensor element and the stiffening blade for transmitting to the stiffening blade, in the form of a unidirectional force oriented generally horizontally and in said longitudinal direction toward only the front end of the stiffening blade, at least a portion of the vertical thrust force of the boot.

2. A device according to claim 1, further comprising:

an arrangement to enable the sensor element to move along a vertical direction and an abutment for limiting upward movement of the sensor element.

3. A device according to claim 2, wherein:

said connection between the sensor element and the stiffening blade comprising a pivotable element having a pair of arms;

a generally horizontal and transverse first axle about which the pivotable element is journalled;

a base adapted to be affixed to the ski, said base bearing the first axle;

a second axle borne by the pivotable element for journalling the rear portion of the stiffening blade with respect to the pivotable element;

said pivotable element having a support surface engageable with said sensor element for receiving the vertical thrust force of the boot and causing the pivotable element to pivot about the first axle and transmitting to the stiffening blade said force oriented generally horizontally and in said longitudinal direction toward the front end of the stiffening blade.

4. A device according to claim 1, wherein:

said stiffening blade comprises means for compression pre-stressing.

5. A device according to claim 1, wherein:

said stiffening blade comprises, along a portion of said predeterminate length, two longitudinally extending members journalled, about a common transverse axis, said two longitudinally extending members being movable between:

(1) a flattened position in the presence of the boot, in which said common transverse axis is moved downwardly and said two longitudinally extending members are generally longitudinally co-extensive and generate an initial longitudinally directed pre-stress, and (2) an open position in the absence of the boot, in which the pre-stress is removed.

6. A device according to claim 5, further comprising:

a journal axle extending along said common transverse axis;

wherein one of said two longitudinally extending journalled members of the stiffening blade comprises means for mounting said journal axle for sliding longitudinally with respect to the other of said two longitudinally extending journalled members; and wherein at least one spring is located on said other of said two longitudinally extending journalled members for providing an elastic return force against said one of said two longitudinally extending journalled members.

7. A device according to claim 6, wherein:

said two longitudinally extending journalled members of the stiffening blade further comprise an abutment device for placing said two longitudinally extending journalled members in rigid longitudinal support in said flattened position.

8. A device according to claim 2, wherein:

said connection between the sensor element and the stiffening blade for transmitting at least a portion of the vertical thrust force of the boot as a generally horizontal and longitudinal force to the stiffening blade comprises a knuckle joint device constituted by two levers journalled with respect to each other about a common horizontal and transverse axis, an end of one of said two levers being connected to an abutment adapted to be affixed to the ski, a free end of the second of said two levers being connected to the stiffening blade, and the sensor element being supported by a central portion of said knuckle joint device.

9. A device according to claim 2, wherein:

said connection between the sensor element and the stiffening blade for transmitting at least a portion of the vertical thrust force of the boot as a generally horizontal and longitudinal force to the stiffening blade comprises a strip of material having an upper central convex portion, one end of the strip adapted to be affixed to the ski and the other end of the strip being connected to the stiffening blade, and the sensor element being supported by a central portion of said strip of material.

10. A device according to claim 2, wherein:

said connection between the sensor element and the stiffening blade for transmitting at least a portion of the vertical thrust force of the boot as a generally horizontal and longitudinal force to the stiffening blade comprises an inclined lever extending between a longitudinal abutment, vertically movable with said sensor element, and the stiffening blade.

11. A device according to claim 1, wherein:

said connection comprises means for transforming vertical movement of said sensor element, in response to said vertical thrust force, to longitudinal movement of a portion of said stiffening blade with respect to a portion the ski.

12. A device according to claim 1, wherein:

said stiffening blade is elongated for extending beneath the sole of the boot; and said device further comprises means for mounting said stiffening blade for longitudinal movement with respect to said sensor element.

13. A device according to claim 1, wherein:

said stiffening member has a length such that said rear end of the stiffening blade is adapted to be located rearward of a front binding element for the boot.

14. A device for modifying force distribution of a ski over a gliding surface of the ski, the ski extending in a longitudinal direction and having a central zone, said device comprising:

a front binding element for retaining a front of a boot and a rear binding element for retaining a rear of the boot, said front binding element and said rear binding element being adapted to be mounted within the central zone of the ski;

a stiffening blade having a front end and a rear end, the front end of the stiffening blade being adapted to be affixed to a forward portion of the ski, the forward portion of the ski being forward of the central zone, the stiffening blade having a predeterminate length so that the rear end of the stiffening blade is adapted to be located in the central zone;

a sensor element, mounted proximate the rear binding element, for supporting a rear portion of the sole of the boot and for capturing a vertical thrust force of the rear of the boot; and a connection between the sensor element and the stiffening blade for transmitting to the stiffening blade, in the form of a unidirectional force oriented generally horizontally and in said longitudinal direction toward only the front end of the stiffening blade, at least a portion of the vertical thrust force of the boot.

15. A device according to claim 14, further comprising:

a rear base adapted to be affixed to the ski;

a slide bearing a generally horizontal and transverse axle for journalling said slide bearing about said rear base;

a body for the rear binding element;

means for mounting said body with respect to said slide;

wherein said sensor element is affixed to said slide.

16. A device according to claim 15, further comprising:

a front base adapted to be affixed to the ski adapted to support the front binding element, said front base having a longitudinally extending recess;

said stiffening blade extending through said longitudinally extending recess of said front base.

17. A device according to claim 14, wherein:

said connection comprises means for transforming vertical movement of said sensor element, in response to said vertical thrust, to longitudinal movement of a portion of said stiffening blade with respect to a portion of the ski.

18. A device according to claim 14, wherein:

said stiffening blade is elongated for extending beneath the sole of the boot; and said device further comprises means for mounting said stiffening blade for longitudinal movement with respect to said sensor element.

19. A device according to claim 14, wherein:

said rear end of the stiffening blade is located rearward of said front binding element.

20. A ski extending in a longitudinal direction, the ski having a central zone with at least one binding element for retaining a boot and at least one support element for supporting a sole of the boot, said ski comprising:

a device for modifying a force distribution of the ski over a gliding surface of the ski, the device including a stiffening blade having a front end and a rear end, the front end of the stiffening blade being affixed to a forward portion of the ski, the forward portion of the ski being forward of the central zone, the stiffening blade having a predeterminate length so that the rear end of the stiffening blade is located in the central zone;

a sensor element for supporting only a rear portion of the sole of the boot and for capturing a vertical thrust force of the boot; and a connection between the sensor element and the stiffening blade for transmitting to the stiffening blade, in the form of a unidirectional force oriented generally horizontally and in said longitudinal direction toward only the front end of the stiffening blade, at least a portion of the vertical thrust force of the boot.

21. A ski according to claim 20, wherein:

said connection comprises means for transforming vertical movement of said sensor element, in response to said vertical thrust, to longitudinal movement of a portion of said stiffening blade with respect to a portion of the ski.

22. A ski according to claim 20, wherein:

said stiffening blade is elongated for extending beneath the sole of the boot; and said device further comprises means for mounting said stiffening blade for longitudinal movement with respect to said sensor element.

23. A ski according to claim 20, wherein:

said rear end of the stiffening blade is located rearward of said front binding element.

* * * * *